US007338314B2

(12) United States Patent
Thai

(10) Patent No.: US 7,338,314 B2
(45) Date of Patent: Mar. 4, 2008

(54) ELECTRICAL WIRE ROUTING CONNECTOR PRESENTER BRACKET

(75) Inventor: Peter Thai, White Lake, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 11/460,305

(22) Filed: Jul. 27, 2006

(65) Prior Publication Data

US 2008/0026601 A1 Jan. 31, 2008

(51) Int. Cl.
*H01R 13/60* (2006.01)

(52) U.S. Cl. ..... 439/528; 248/51; 439/527; 439/34

(58) Field of Classification Search ..... 439/34, 439/528, 575, 527, 542; 248/51
See application file for complete search history.

(56) References Cited

U.S. PATENT DOCUMENTS 2,997,531 A * 8/1961 Oldham et al. ..... 174/158 R
3,176,257 A * 3/1965 Introvigne ..... 439/528
4,067,635 A * 1/1978 Solberg ..... 439/574
4,360,241 A * 11/1982 Fukunaga ..... 439/34
4,943,109 A 7/1990 Skrbina et al.
5,130,890 A * 7/1992 Nhu ..... 361/724
5,288,094 A * 2/1994 Putnam ..... 280/420
5,324,203 A 6/1994 Sano et al.
5,382,179 A * 1/1995 Noschese ..... 439/533
5,732,966 A * 3/1998 Menard et al. ..... 280/422
5,735,041 A 4/1998 Zaguskin et al.
5,885,098 A * 3/1999 Witkowski ..... 439/369
6,000,949 A 12/1999 Takiguchi et al.
6,039,598 A * 3/2000 Ciavarella ..... 439/451
6,159,019 A 12/2000 Norizuki et al.
6,171,118 B1 * 1/2001 Witkowski et al. ..... 439/142
6,217,358 B1 4/2001 Norizuki et al.
6,343,939 B1 * 2/2002 Inoue ..... 439/34
6,449,907 B2 9/2002 Nishikawa et al.
6,528,900 B1 3/2003 Serizawa et al.
6,537,105 B2 * 3/2003 Higashida et al. ..... 439/528
6,870,097 B2 * 3/2005 Oda ..... 174/50
6,890,211 B2 * 5/2005 Inagaki et al. ..... 439/544
6,994,558 B2 * 2/2006 Cortinovis ..... 439/34
7,021,962 B2 * 4/2006 Kiyota ..... 439/528
7,294,783 B2 * 11/2007 Schneider et al. ..... 174/72 A

* cited by examiner

*Primary Examiner*—Neil Abrams
(74) *Attorney, Agent, or Firm*—Gigette Bejin, Esq.; Dykema Gossett PLLC

(57) ABSTRACT

A connector bracket for facilitating assembly of an electrical component to an automobile. The connector bracket may include a proximal support configured to attach to an attachment structure of an automobile, and a distal support including a flange for retaining an electrical connector in a storage position. The proximal and/or distal supports may include one or more hooks for retaining wiring extending from the electrical connector. Further, the distal support may be positioned relative to the proximal support such that when the proximal support is attached to the attachment structure and when the electrical connector is retained by the distal support, the electrical connector is accessible and removable from its storage positions on the distal support, through an opening in which the electrical component is to be installed, to enable attachment of the electrical component to the electrical connector. The invention also provides a method for assembling an electrical component to an automobile using the aforedescribed connector bracket.

18 Claims, 9 Drawing Sheets

ELECTRICAL WIRE ROUTING CONNECTOR PRESENTER BRACKET

BACKGROUND OF INVENTION a. Field of Invention

The invention relates generally to automobile design and assembly, and, more particularly, to a bracket for use with and facilitating the assembly of an electrical connector to an associated electrical component.

b. Description of Related Art

As is known in the art, the speed and simplicity of automobile assembly is of importance for maintaining economic efficiency and minimizing build variations. In the assembly of automobile doors for example, it is necessary to quickly and correctly connect various electrical components to an internal wiring system, all of which must be done in a limited space. Some of these components must be installed on an external side of a door frame, with wires and connectors extending into the interior of the door frame. Because the door assembly is a closed structure, making such connections through small openings after the structure is sealed can be difficult and time consuming.

The electrical wiring for electrical components used in modern automobiles is generally terminated by an electrical connector configured to fit a receiving connector on the electrical component. Such electrical components include for example window or door lock switches which may be installed in the interior of a door structure, or entry keypads which may be installed on the exterior of the door structure.

The wiring from such electrical components generally extends freely from the component to a wiring harness contained within the automobile body. The wiring, if not secured in some way, can interfere with the operation of other components, such as a window mechanism, of the door assembly.

When an electrical component is installed into an opening after the door assembly is sealed, in order to retrieve the associated electrical connector for subsequent assembly procedures, an assembler must manually locate the connector through an opening, and must further attempt to locate and grasp the end of the connector. Depending on the orientation of the connector within the door assembly, in certain circumstances, this may prove impossible and require disassembly of the door module for retrieval of the connector. As readily apparent, such assembly methods can be inefficient and can cause costly delays on an assembly line.

A variety of methods have been suggested for restraining the wiring to such components, either by clipping the wiring to body paneling or otherwise restraining the wiring in a harness. U.S. Pat. No. 5,735,041 to Zaguskin for example discloses a method of sequentially securing the main door wiring harness for an automobile to a panel to assist in routing the main wire harness. However, Zaguskin does not address problems associated with positioning of individual connectors. U.S. Pat. No. 6,000,949 to Takiguchi discloses a flexible circuit plate mounted to the surface of interior door trim. Takiguchi, however, does not facilitate retrieval of a connector from the interior of the door cavity, nor does it allow flexibility of design of the connector, wiring or opening. U.S. Pat. No. 6,528,900 to Serizawa discloses a bracket as a means of support for a switch panel, but not for holding a connector or pre-positioning the same. U.S. Pat. No. 6,449,907 to Nishikawa discloses a mounting panel to which wiring may be attached and from which various plastic panels may be removed to assist in assembly. Nisikawa, however, does not provide a means for pre-positioning individual connectors for facilitating assembly.

Other methods of simplifying door panel and electrical component construction have also been suggested. U.S. Pat. No. 4,943,109 to Skrbina discloses the prearrangement of fixed connectors on a door panel as a means of maintaining the connectors in a stationary location for connecting to a rigid panel. U.S. Pat. No. 5,324,203 to Sano likewise uses a system of pre-positioned connectors with guide rails for aligning corresponding panels during assembly. Both systems use permanently placed connectors connected to another panel, rather than individual components. Based on the teachings of the aforementioned references, it is not known to combine a restraint for such wiring with a bracket for positioning the connector end of the wiring for retrieval through the opening in which the component will be installed. It is also not known to provide a temporary connector presenter bracket for the purpose of pre-positioning a connector for ease of assembly.

Yet further, a method is disclosed in U.S. Pat. No. 6,159,019 to Norizuki (Norizuki '019) for coordinating fittings in an opening to which an interior door electrical component is to be installed. The Norizuki '019 method, however, does not solve the problem of how to coordinate the fittings near such an opening for facilitating withdrawal through the opening after the door module is sealed. Rather, Norizuki '019 discloses a method for coordinating wiring during the course of assembly of the interior door panel itself, using a plug-and-socket technique. Furthermore, Norizuki '019 requires a holder formed integrally with the opening and socket itself, and thus limits the durability of the electrical component, as well as limiting the flexibility of design. Such an method would be unsuitable for use in an exterior application requiring durability against weather and the elements as well as security against would-be intruders. Likewise, U.S. Pat. No. 6,217,358 to Norizuki (Norizuki '358) discloses a similar method using a fixed, freely slidable connector. Such a connector likewise has limited movement in only one dimension and would not provide the advantages of a freely adjustable connector temporarily held in a bracket.

It is therefore desirable to provide a means of coordinating an electrical connector at or near an opening in which a corresponding electrical component will be installed for facilitating efficient and simple retrieval of the connector through the opening. It is desirable to provide a means for pre-positioning such a connector, while eliminating the need for redesign of the opening in which the component will be installed. It is also desirable to prevent the wires emanating from such a device from interfering with the operation of other important automobile components.

SUMMARY OF INVENTION

The invention solves the problems and overcomes the drawbacks and deficiencies of prior art techniques for the assembly and connection of electrical components in automobile doors by providing a connector bracket for facilitating assembly of an electrical component to an automobile. The connector bracket may include a proximal support configured to attach to an attachment structure of an automobile, and a distal support including one or more flanges for retaining an electrical connector connectable to the electrical component for supplying power thereto. The proximal and/or distal supports may include one or more hooks for retaining wiring extending from the electrical connector. The distal support may be positioned relative to the proximal support such that when the proximal support is attached to the attachment structure and when the electrical connector is retained by the distal support, the electrical connector is accessible and removable from the distal support, through an opening in which the electrical component is to be installed, to enable attachment of the electrical component to the electrical connector.

For the connector bracket described above, the flange on the distal support may include one or more protrusions for engaging a complementary groove of the electrical connector and for removably retaining the electrical connector to the distal support. The distal support may be connected to the proximal support by an intermediate angled connection for maintaining the distal support at a predetermined orientation relative to the proximal support. The proximal support may include one or more openings for insertion of a fastener for attachment of the connector bracket to the attachment structure of the automobile. In a particular embodiment of the present invention, the attachment structure of the automobile may include an inner door handle assembly, and the electrical component may be a door entry keypad. Further, the connector bracket may be formed of a polymer material. The distal support may further include an extension for retaining wires of the electrical connector in a predetermined position to prevent interference of the wires with adjacent automobile components. The extension may include a flange for retaining wires of the electrical connector in a predetermined position.

The invention also provides a connector bracket for facilitating assembly of an electrical component to an automobile. The connector bracket may include a proximal support configured to attach to an attachment structure of an automobile, and a distal support including one or more flanges for retaining an electrical connector connectable to the electrical component for supplying power thereto. The distal support may be positioned relative to the proximal support such that when the proximal support is attached to the attachment structure and when the electrical connector is retained by the distal support, the electrical connector is accessible and removable from the distal support, through an opening in which or adjacent which the electrical component is to be installed, to enable attachment of the electrical component to the electrical connector.

For the connector bracket described above, the proximal and/or distal supports may include one or more hooks for retaining wiring extending from the electrical connector. Further, the flange on the distal support may include one or more protrusions for engaging a complementary groove of the electrical connector and for removably retaining the electrical connector to the distal support.

The invention also provides a method for assembling an electrical component to an automobile. The method may include providing a connector bracket having proximal and distal supports, with the proximal support configured to attach to an attachment structure of an automobile, and the distal support including one or more flanges for retaining an electrical connector connectable to the electrical component for supplying power thereto. The method may further include securing the proximal support to the attachment structure, securing the electrical connector to the distal support, accessing the electrical connector through an opening in which or adjacent which the electrical component is to be installed, removing the electrical connector from the distal support, connecting the electrical connector to the electrical component, and installing the electrical component in the opening.

For the method described above, the flange on the distal support may include one or more protrusions for engaging a complementary groove of the electrical connector and for removably retaining the electrical connector to the distal support. The method may further include connecting the distal support to the proximal support by an intermediate angled connection for maintaining the distal support at a predetermined orientation relative to the proximal support. The method may further include securing the proximal support to the attachment structure by a fastener inserted in an opening in the proximal support for attachment of the connector bracket to the attachment structure of the automobile. In a particular embodiment, the attachment structure of the automobile may include an inner door handle assembly, and the electrical component may be a door entry keypad. The method may also include retaining wires of the electrical connector in a predetermined position by an extension on the distal support, and retaining wires of the electrical connector in a predetermined position by a flange on the extension.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detail description serve to explain the principles of the invention. In the drawings.

DETAILED DESCRIPTION OF THE PREFERRED EMBODIMENTS

Figure 1A:
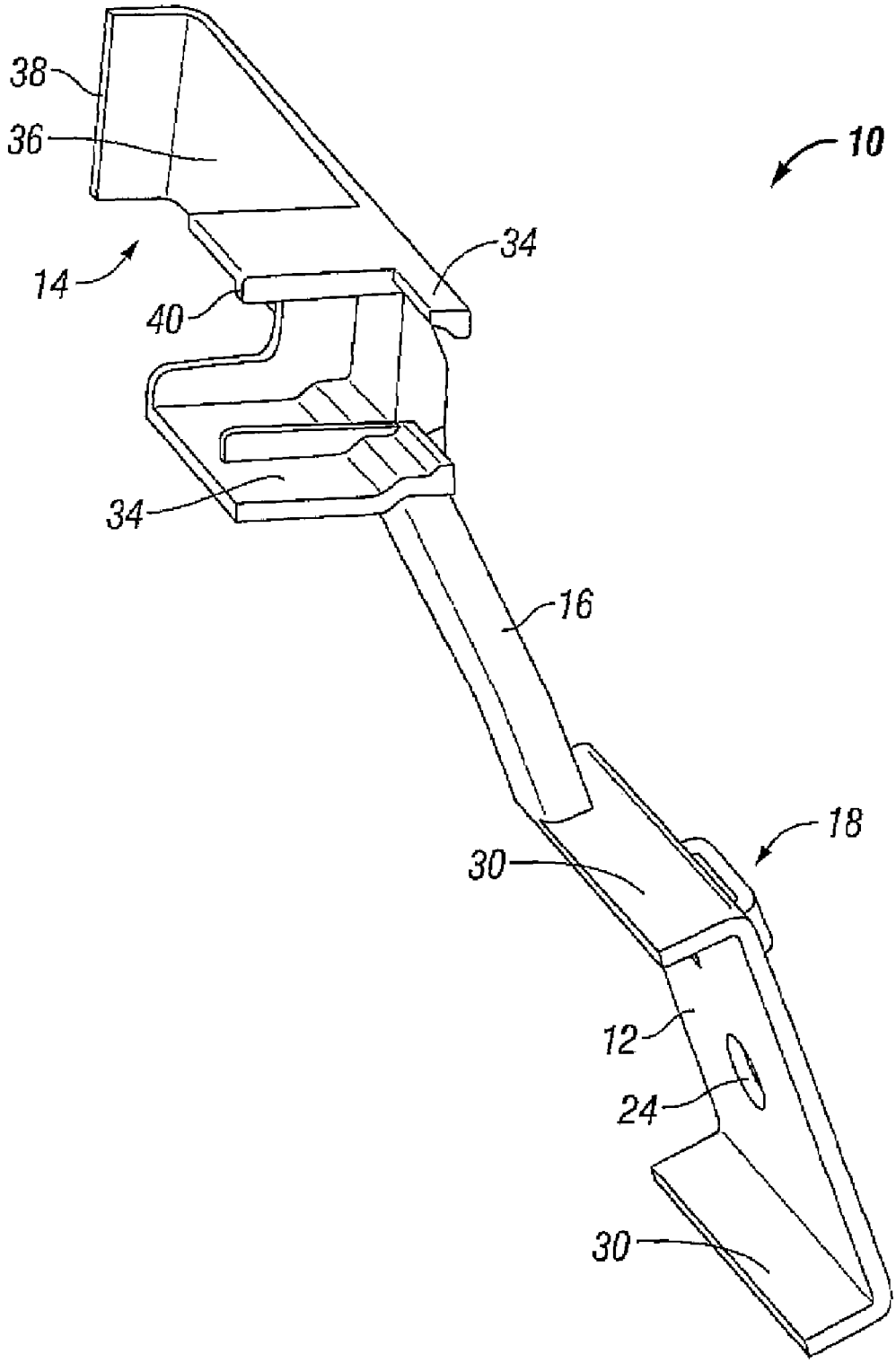
FIGS. 1A and 1B are respectively isometric and front views of a connector presenter wire routing bracket (hereinafter designated "connector bracket") according to the present invention for facilitating the assembly of an automobile electronic component.

Referring now to the drawings wherein like reference numerals designate corresponding parts throughout the several views, FIGS. 1A-8 illustrate various exemplary views of an electrical connector presenter and wire routing connector bracket (hereinafter designated "connector bracket") according to the present invention, mounted on an inner automobile door chassis.

Figure 1B:
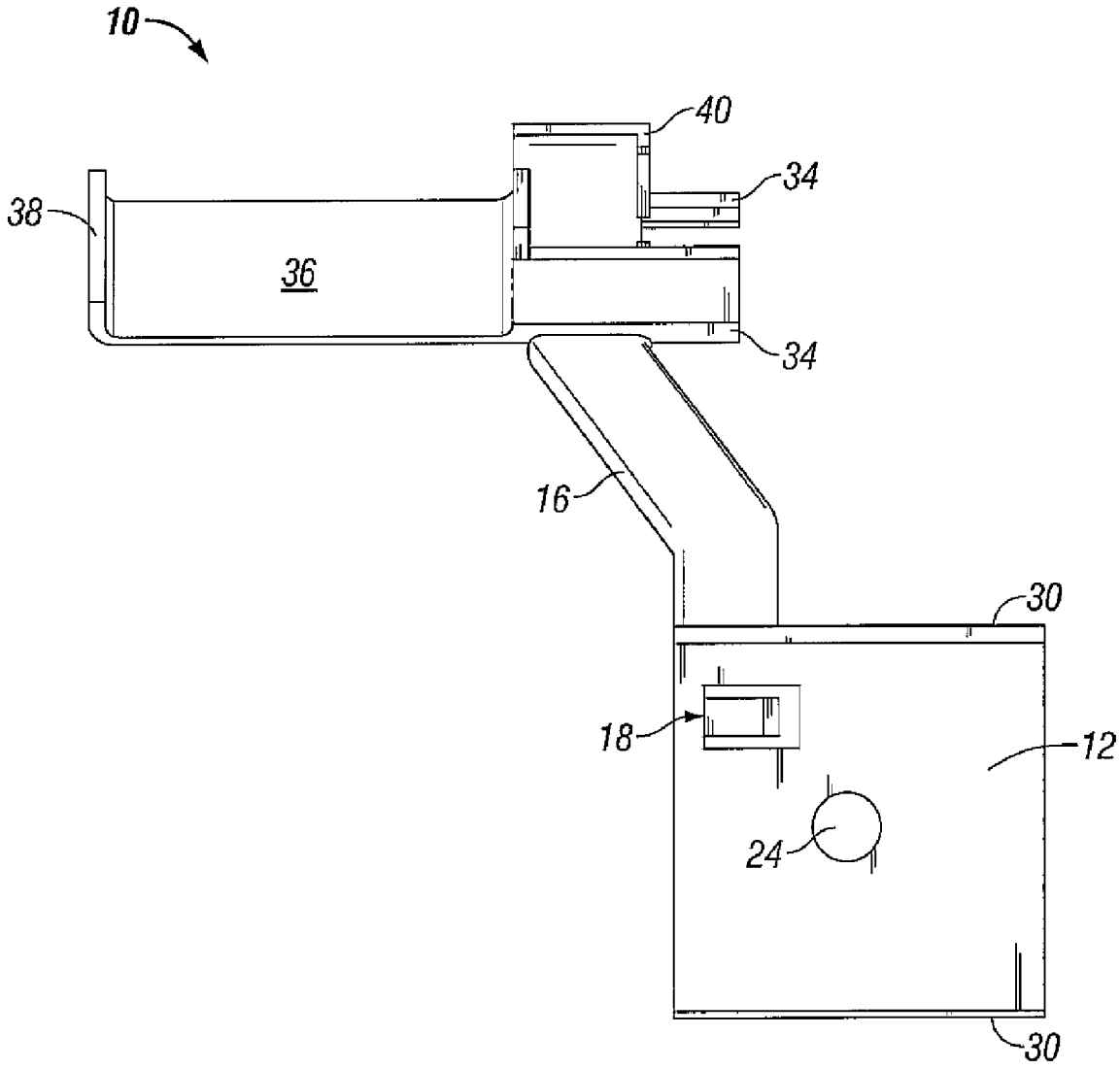
Figure 2:
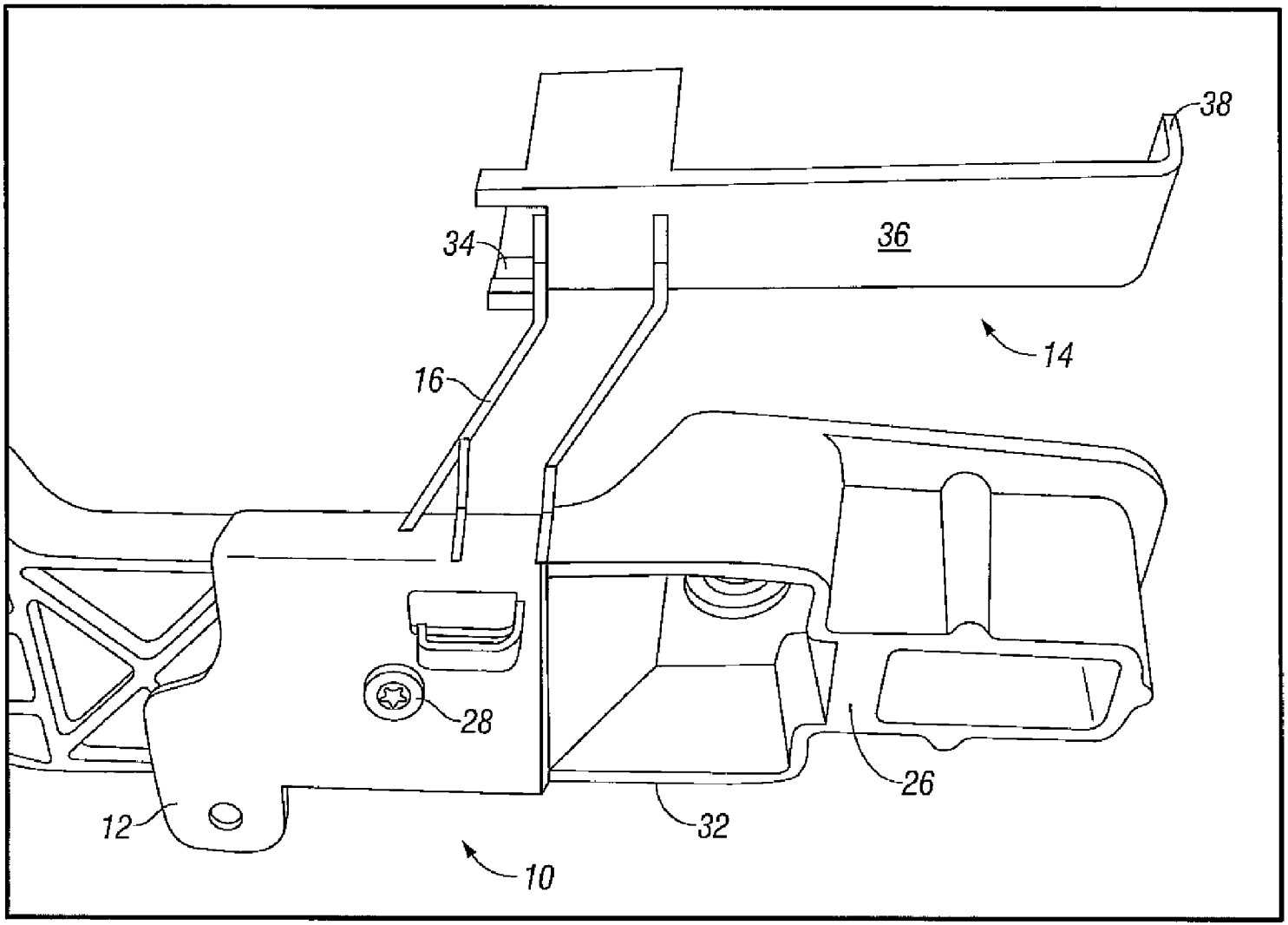
FIG. 2 is a view from the opposite perspective of FIG. 1B, showing the connector bracket attached to an inner door handle chassis, without an electrical connector installed.

Referring to FIGS. 1A, 1B and 2, the present invention generally provides a connector bracket 10 for facilitating the assembly of an electrical component having a corresponding electrical connector in the assembly of an automobile. In the particular embodiment of connector bracket 10 illustrated in FIGS. 1A and 1B, bracket 10 may generally include a proximal support 12 oriented in a predetermined configuration and angle relative to a distal support 14 by means of an angled connection 16. Proximal support 12 may generally include one or more hooks 18 for retaining electrical wiring 20 of an electrical connector 22 (see FIG. 5) and routing the wiring or bundle of wires generally toward a main wiring harness (not shown). Hooks 18 may be stamped or otherwise formed in the structure of proximal support 12. Proximal support 12 may further include one or more openings 24 for attachment of connector bracket 10 to an inner door handle chassis 26 (see FIG. 3) by means of a fastener 28 (see also FIG. 3) and the like. A pair of mirror-image flanges 30 may be provided for facilitating retention and alignment of connector bracket 10 on structural member 32 of the inner door handle chassis.

Referring again to FIGS. 1A and 1B, distal support 14 may include a plurality of flanges 34 for removably retaining electrical connector 22 for subsequent assembly procedures as discussed below. An extension 36 may be provided and include a flange 38 at an end thereof for retaining wiring 20 in a predetermined configuration to prevent interference thereof with adjacent components of the door assembly.

The assembly and use of connector bracket 10 will now be described in detail with reference to FIGS. 1A-8.

Figure 3:
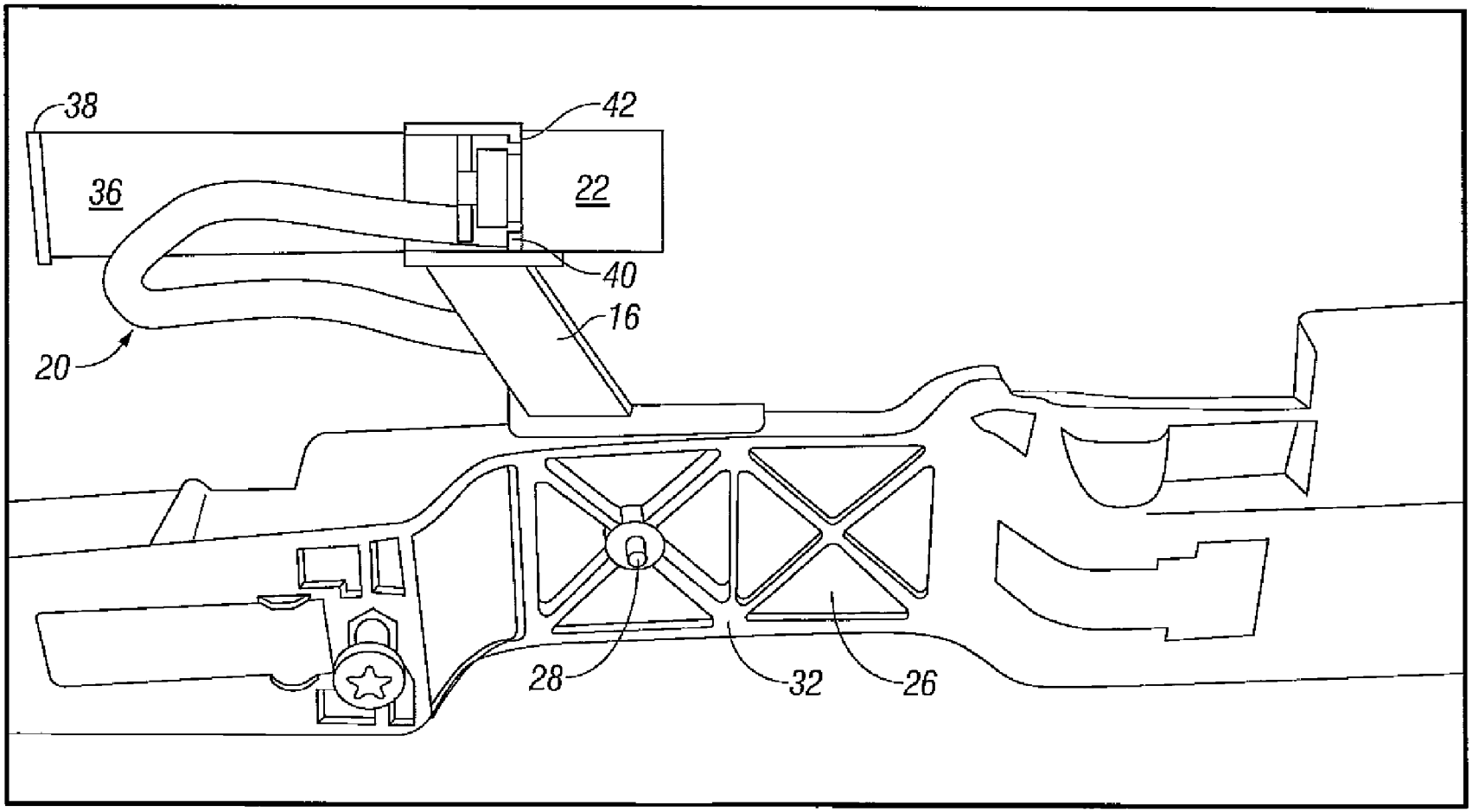
FIG. 3 is a view from the perspective of FIG. 1B, shown with the connector bracket attached to an inner door handle chassis with all electrical connector installed in the connector bracket and wiring visible.
Figure 4:
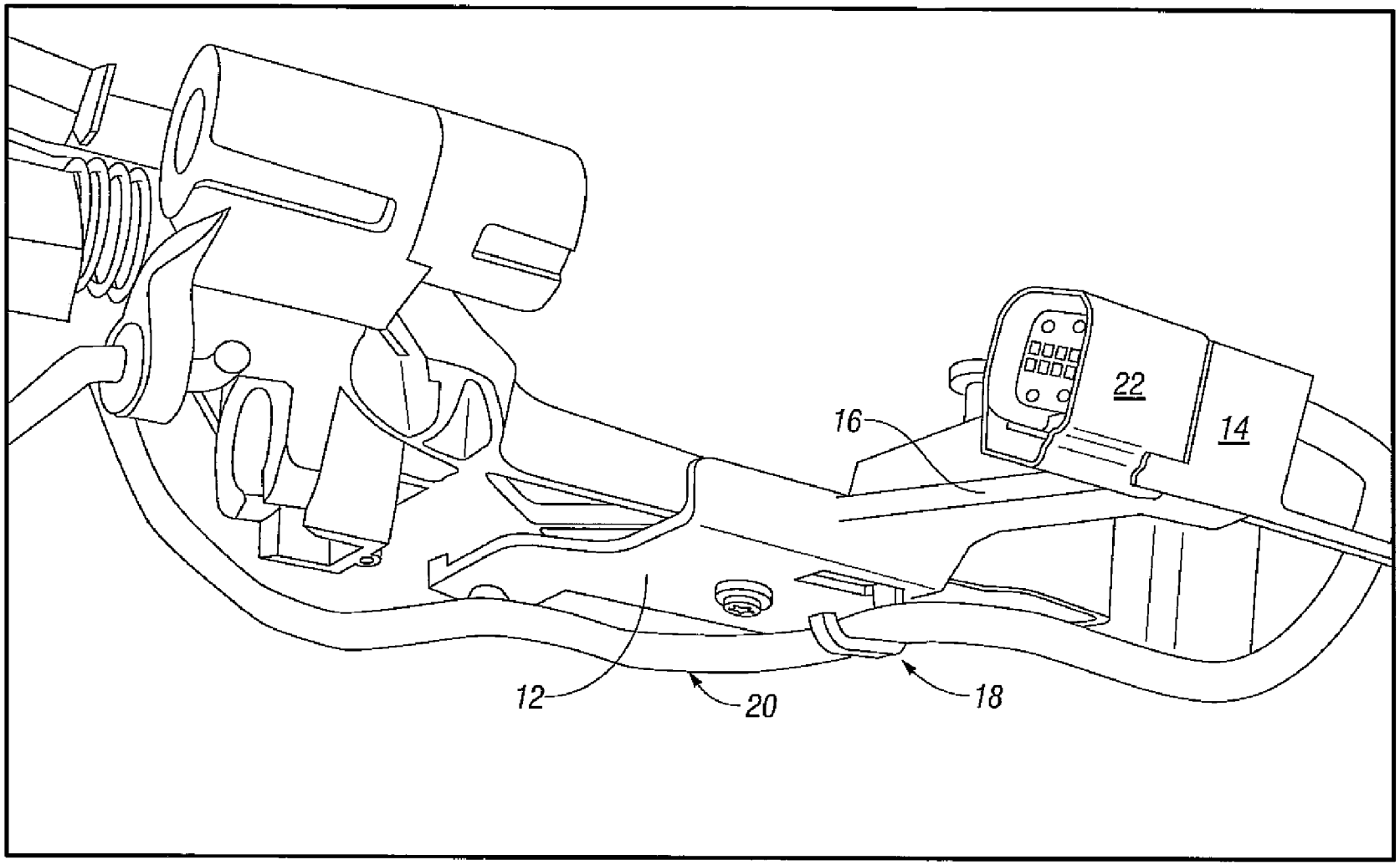
FIG. 4 is an elevated view of the connector bracket attached to all inner door handle chassis with an electrical connector installed, and wiring visible.
Figure 5:
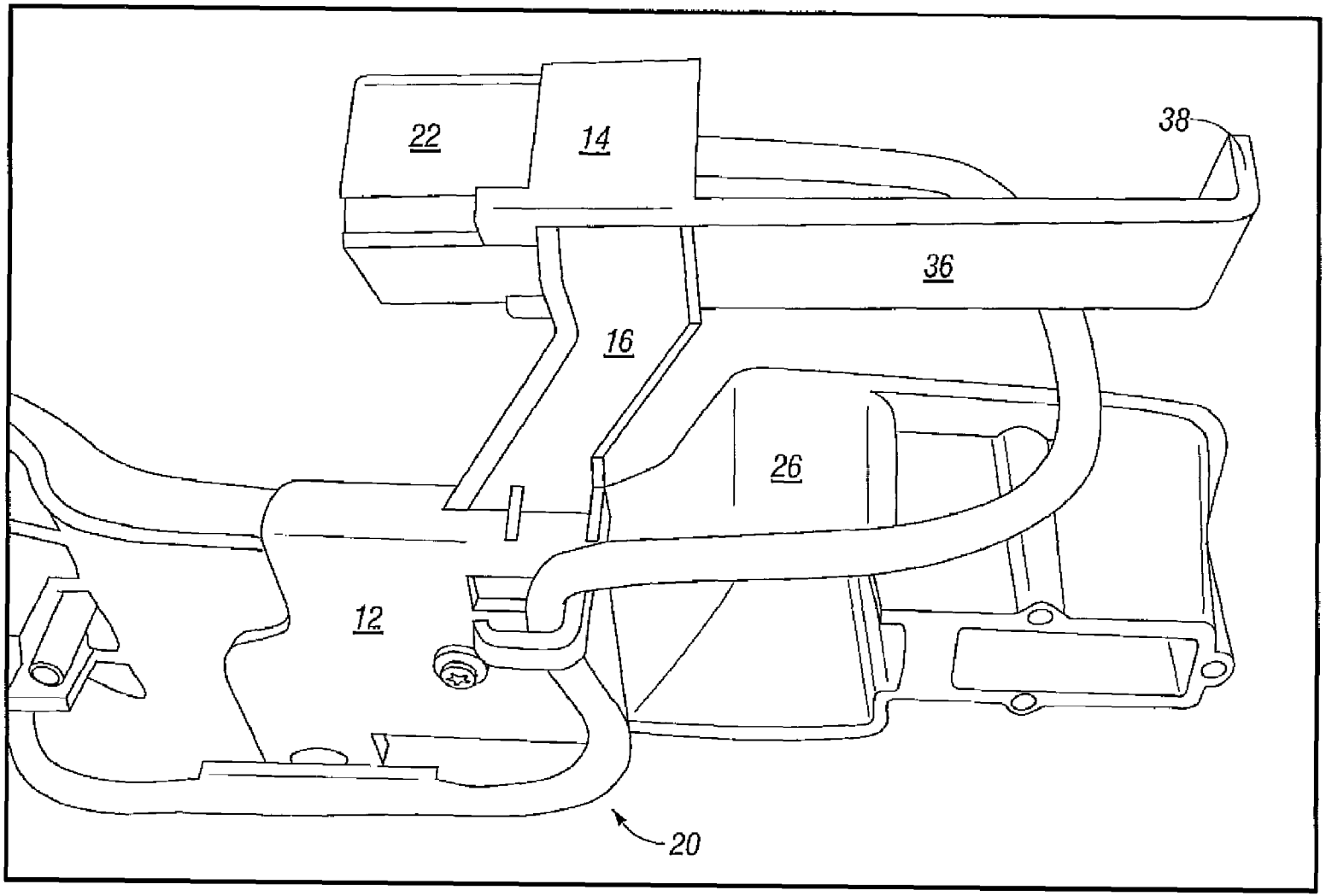
FIG. 5 is an overhead view of the connector bracket attached to an inner door handle chassis with an electrical connector installed, and wiring visible.
Figure 6:
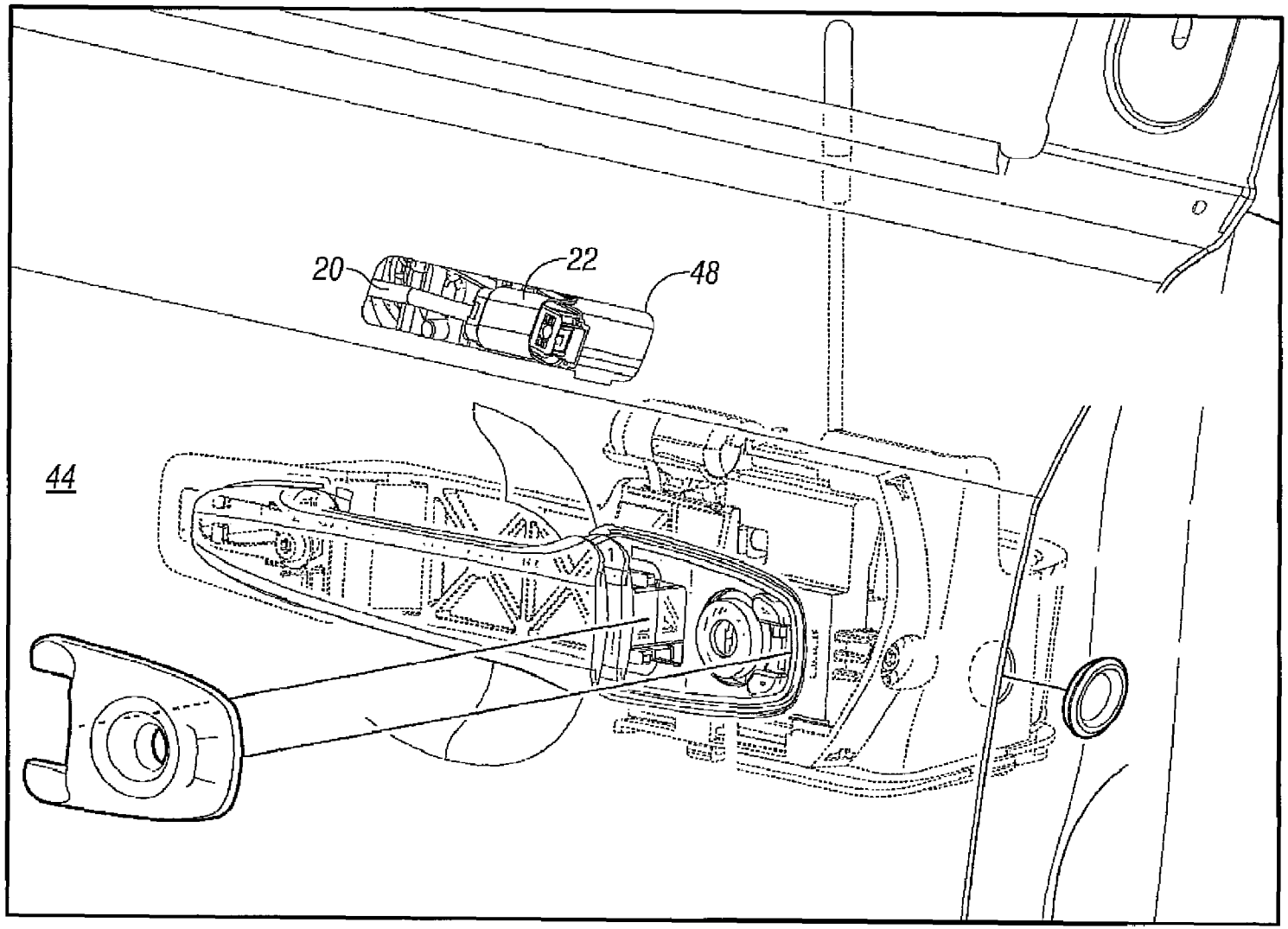
FIG. 6 is an assembled automobile door assembly with the connector bracket and electrical connector in place visible through an opening into which a keypad is to be installed.

Referring to FIG. 3, during the door assembly process, connector bracket 10 may be installed to inner door handle chassis 26 by means of fastener 28. Once installed, wiring 20 of electrical connector 22 may be routed adjacent extension 36, and connector 22 may be inserted within flanges 34. Alternatively, connector bracket 10 may be installed to inner door handle chassis 26 with electrical connector 22 already inserted within flanges 34. As shown in FIGS. 1A and 1B, flanges 34 may include an internal configuration for providing complementary engagement with the external structure of electrical connector 22. In a particular embodiment of connector bracket 10, flanges 34 may include protrusions 40 for insertion into complementary grooves 42 of electrical connector 22. Referring to FIG. 6, with connector 22 removably attached to connector bracket 10, the door assembly may be sealed as needed, by, for example, attachment of outer door panel 44 and subsequent operations.

Figure 7:
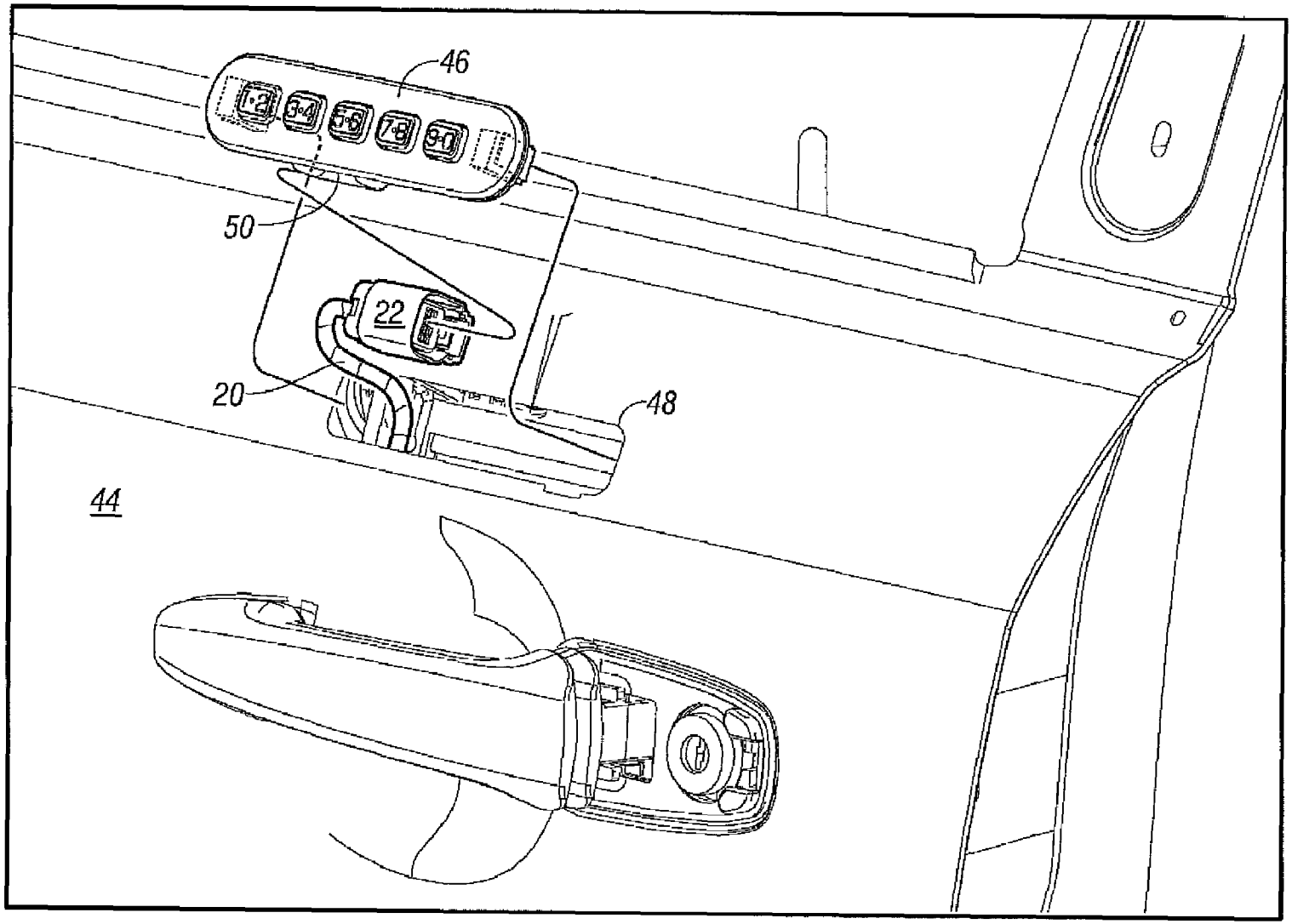
FIG. 7 is the same view as FIG. 6 with the electrical connector removed from the connector bracket and withdrawn through the opening to be attached to the keypad.
Figure 8:
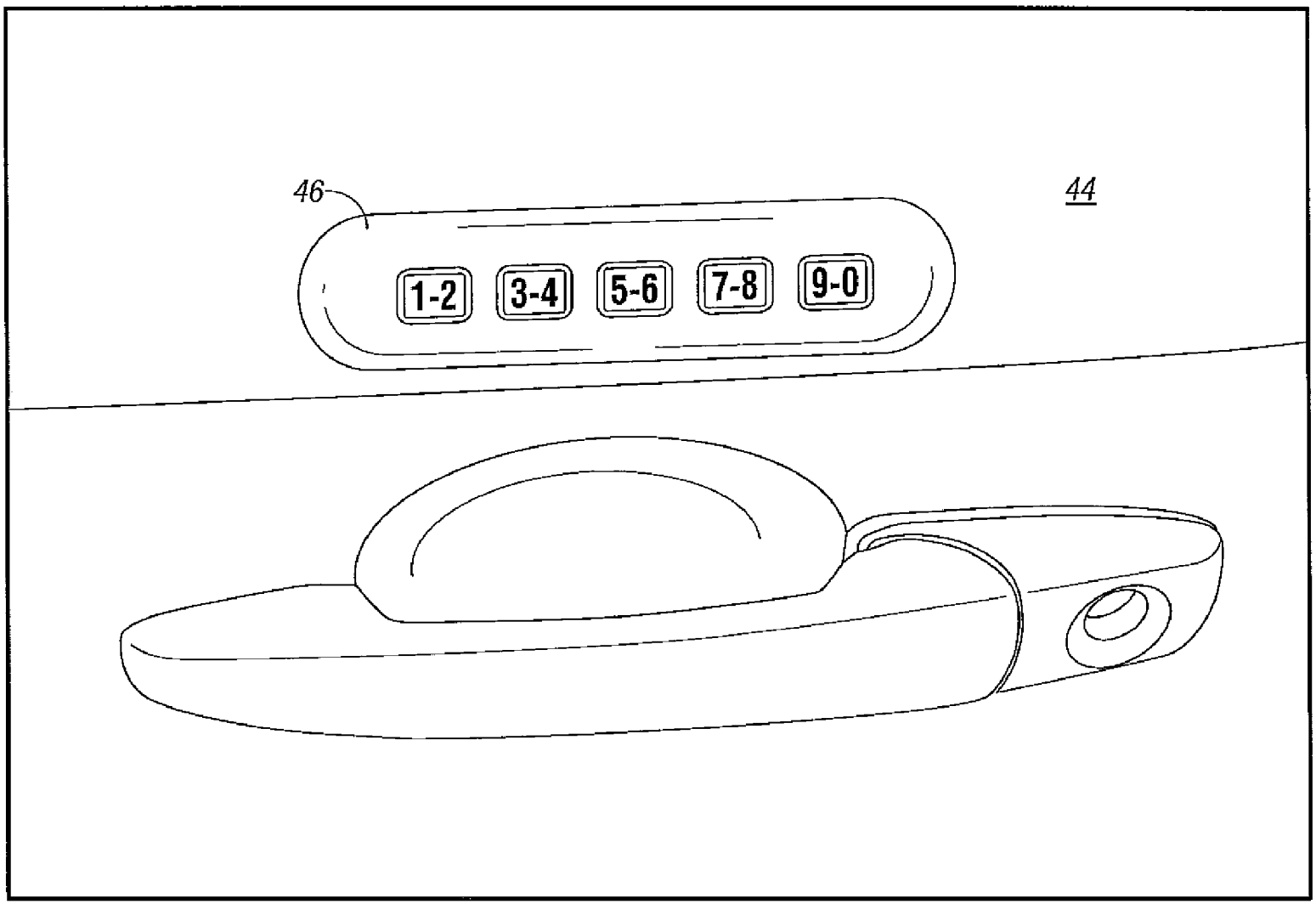
FIG. 8 is the installed keypad in place in an automobile door.

Referring to FIGS. 6 and 7, in order to assemble electrical component 46, which in the particular example illustrated is a door lock release keypad, an assembler may first simply reach into opening 48 to remove electrical connector 22, which is positioned adjacent opening 48 due to the predetermined orientation of distal end 14 relative to proximal end 12, from within flanges 34. With electrical connector 22 now protruding out from opening 48, the assembler may join complementary connector 50 of electrical component 46 to connector 22 and re-insert the assembly (i.e. electrical connector 22 and complementary connector 50) back through opening 48. Electrical component 46 may thereafter be installed into opening 48 by its normal assembly procedure. Connector bracket 10, which as discussed above may be made of a polymer material, may be left in place and add negligible weight to the overall door structure.

Those skilled in the art would readily appreciate in view of this disclosure that several modifications may be made to connector bracket 10 without departing from the scope of the present invention.

For example, referring to FIGS. 1A and 1B, angled connection 16 may be configured in any manner needed for locating distal support 14 relative to proximal support 12 for a particular vehicular configuration. Proximal support 14 may include a plurality of hooks 18 for retaining electrical wiring 20, and further, hooks 18 may be provided on extension 36 and/or angled connection 16 for facilitating further retention of electrical wiring 20. Distal support 14 may include further flanges similar to flange 38 for retaining wiring 20 in a predetermined configuration to prevent interference thereof with adjacent components. The area adjacent flanges 34, as well as protrusions 40, may be configured as needed for engagement with a complementary electrical connector 22. Compared to the configuration of FIGS. 1A and 1B which includes a single proximal and a single distal support, a plurality of proximal and/or distal supports (not shown) may be provided for facilitating connection of a multiplicity of electrical connectors and/or components. Yet further, whereas connector bracket 10 has been illustrated for use with a door mounted electrical component (i.e. a keypad), those skilled in the art would readily appreciate in view of this disclosure that bracket 10 may be used in a variety of other locations in an automobile for attaching other electrical components, such as, door/window switches, instrument panel switches, and virtually any electrical component which may be removably attached to an automobile.

Although particular embodiments of the invention have been described in detail herein with reference to the accompanying drawings, it is to be understood that the invention is not limited to those particular embodiments, and that various changes and modifications may be effected therein by one skilled in the art without departing from the scope or spirit of the invention as defined in the appended claims.

What is claimed is:

1. A method for assembling an electrical component to an automobile, said method comprising:

providing a connector bracket having proximal and distal supports, said proximal support configured to attach to an attachment structure of the automobile, said distal support including at least one flange for retaining an electrical connector connectable to the electrical component for supplying power thereto;

securing said proximal support to the attachment structure;

securing the electrical connector to said distal support;

accessing the electrical connector through an opening in which or adjacent which the electrical component is to be installed;

removing the electrical connector from said distal support;

connecting the electrical connector to the electrical component; and installing the electrical component in the opening, wherein the attachment structure of the automobile includes an inner door handle assembly.

2. A method according to claim 1, wherein said flange on said distal support includes at least one protrusion for engaging a complementary groove of the electrical connector and for removably retaining the electrical connector to said distal support.

3. A method according to claim 1, further comprising connecting said distal support to said proximal support by an intermediate angled connection for maintaining said distal support at a predetermined orientation relative to said proximal support.

4. A method according to claim 1, further comprising securing said proximal support to the attachment structure by a fastener inserted in an opening in said proximal support for attachment of said connector bracket to the attachment structure of the automobile.

5. A method according to claim 1, further comprising retaining wires of the electrical connector in a predetermined position by an extension on said distal support.

6. The method according to claim 5, further comprising retaining wires of the electrical connector in a predetermined position by a flange on said extension.

7. A method for assembling an electrical component to an automobile, said method comprising:

providing a connector bracket having proximal and distal supports, said proximal support configured to attach to an attachment structure of the automobile, said distal support including at least one flange for retaining an electrical connector connectable to the electrical component for supplying power thereto;

securing said proximal support to the attachment structure;

securing the electrical connector to said distal support;

performing an assembly operation on the automobile, and thereafter, accessing the electrical connector;

removing the electrical connector from said distal support;

connecting the electrical connector to the electrical component; and installing the electrical component, wherein the attachment structure of the automobile includes an inner door handle assembly.

8. A method according to claim 7, wherein said flange on said distal support includes at least one protrusion for engaging a complementary groove of the electrical connector and for removably retaining the electrical connector to said distal support.

9. A method according to claim 7, further comprising connecting said distal support to said proximal support by an intermediate angled connection for maintaining said distal support at a predetermined orientation relative to said proximal support.

10. A method according to claim 7, further comprising securing said proximal support to the attachment structure by a fastener inserted in an opening in said proximal support for attachment of said connector bracket to the attachment structure of the automobile.

11. A method according to claim 7, further comprising retaining wires of the electrical connector in a predetermined position by an extension on said distal support.

12. The method according to claim 11, further comprising retaining wires of the electrical connector in a predetermined position by a flange on said extension.

13. A method for assembling an electrical component to an automobile, said method comprising:

providing a connector bracket having proximal and distal supports, said proximal support configured to attach to an attachment structure of the automobile, said distal support including at least one flange for retaining an electrical connector connectable to the electrical component for supplying power thereto;

securing said proximal support to the attachment structure;

securing the electrical connector to said distal support;

accessing the electrical connector through an opening in which or adjacent which the electrical component is to be installed;

removing the electrical connector from said distal support;

connecting the electrical connector to the electrical component; and installing the electrical component in the opening, wherein the electrical component is a door entry keypad.

14. A method for assembling an electrical component to an automobile, said method comprising:

providing a connector bracket having proximal and distal supports, said proximal support configured to attach to an attachment structure of the automobile, said distal support including at least one flange for retaining an electrical connector connectable to the electrical component for supplying power thereto;

securing said proximal support to the attachment structure;

securing the electrical connector to said distal support;

performing an assembly operation on the automobile, and thereafter, accessing the electrical connector;

removing the electrical connector from said distal support;

connecting the electrical connector to the electrical component; and installing the electrical component, wherein the electrical component is a door entry keypad.

15. A method for assembling an electrical component to an automobile, said method comprising:

providing a connector bracket having first and second supports, said first support configured to attach to an attachment structure of the automobile, said second support configured to retain an electrical connector connectable to the electrical component for supplying power thereto;

securing said first support to the attachment structure;

securing the electrical connector to said second support;

performing an assembly operation on the automobile, and thereafter, accessing the electrical connector;

removing the electrical connector from said second support; and connecting the electrical connector to the electrical component, wherein the attachment structure of the automobile includes an inner door handle assembly.

16. A method according to claim 15, further comprising connecting said second support to said first support by an intermediate angled connection for maintaining said second support at a predetermined orientation relative to said first support.

17. A method for assembling an electrical component to an automobile, said method comprising:

providing a connector bracket having first and second supports, said first support configured to attach to an attachment structure of the automobile, said second support configured to retain an electrical connector connectable to the electrical component for supplying power thereto;

securing said first support to the attachment structure;

securing the electrical connector to said second support;

performing an assembly operation on the automobile, and thereafter, accessing the electrical connector;

removing the electrical connector from said second support; and connecting the electrical connector to the electrical component, wherein the electrical component is a door entry keypad.

18. A method according to claim 15, further comprising retaining wires of the electrical connector in a predetermined position by an extension on said second support.

* * * * *